United States Patent [19]

Kenney

[11] 3,963,061

[45] June 15, 1976

[54] APPARATUS FOR DRAWING LIQUIDS INTO, AND EXPELLING LIQUIDS FROM A PIPETTE

[75] Inventor: James W. Kenney, West Chester, Pa.

[73] Assignee: Drummond Scientific Company, Broomall, Pa.

[22] Filed: Sept. 16, 1975

[21] Appl. No.: 613,894

[52] U.S. Cl. ..... 141/21; 73/425.4 P; 222/373

[51] Int. Cl.[2] ..... B65B 3/18

[58] Field of Search ..... 222/373, 470; 141/21, 141/25, 67; 74/425.4 P

[56] References Cited

UNITED STATES PATENTS 2,994,349 8/1961 Demos ..... 141/21

3,656,517 4/1972 Taylor et al. ..... 141/67 X

*Primary Examiner*—Allen N. Knowles
*Assistant Examiner*—Hadd S. Lane
*Attorney, Agent, or Firm*—Shlesinger, Arkwright, Garvey & Dinsmore

[57] ABSTRACT

Apparatus for drawing liquids into, and expelling liquids from, a pipette including a housing comprising a hand-held pistol grip to which is connected a pipette-supporting portion. Valve means mounted on the pistol grip beneath two fingers of the user permit selective application of pressure or vacuum to one end of the pipette for drawing the liquid into, and expelling the liquid from, the pipette.

16 Claims, 9 Drawing Figures

Fig. 1
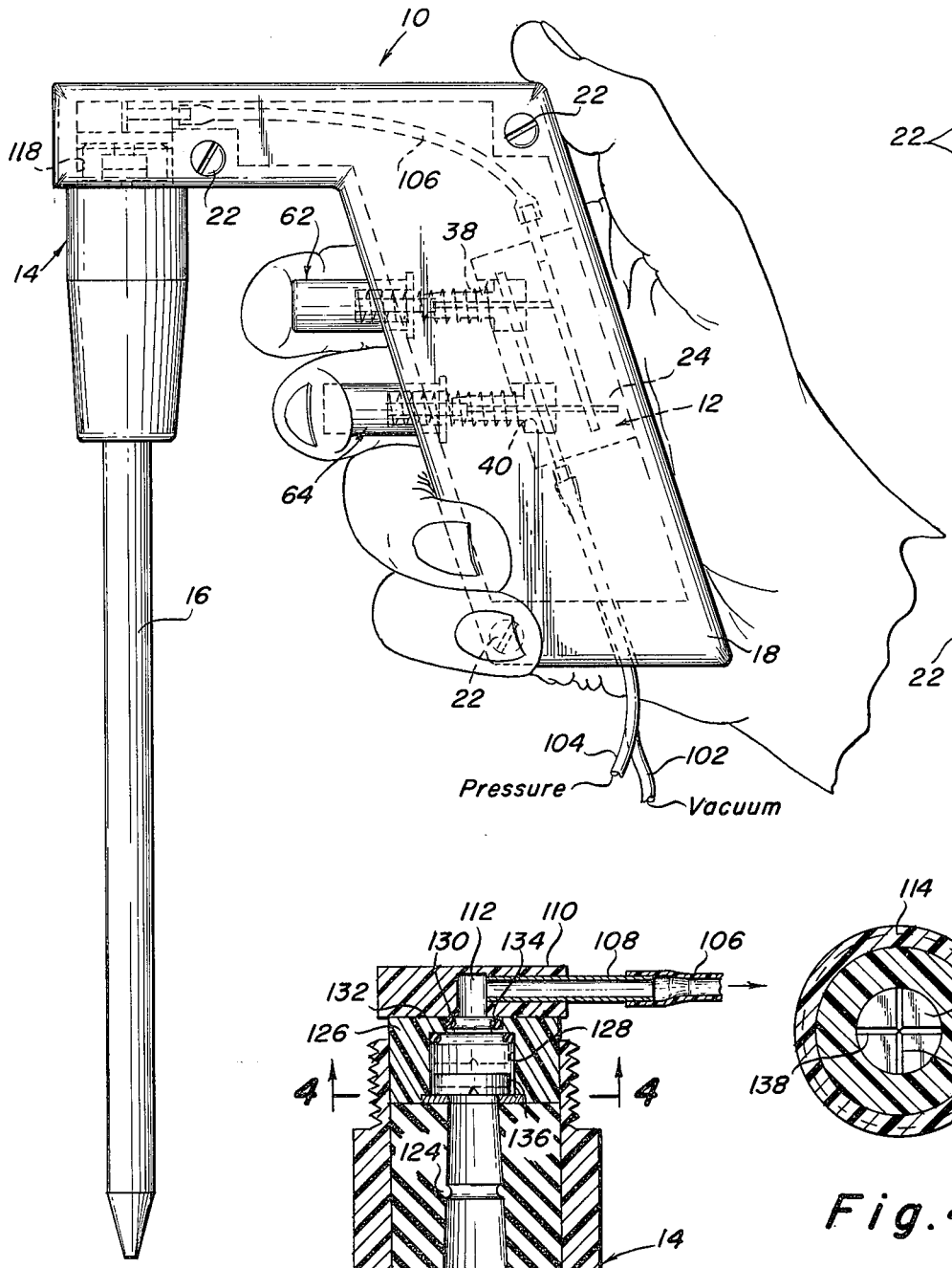
Fig. 2
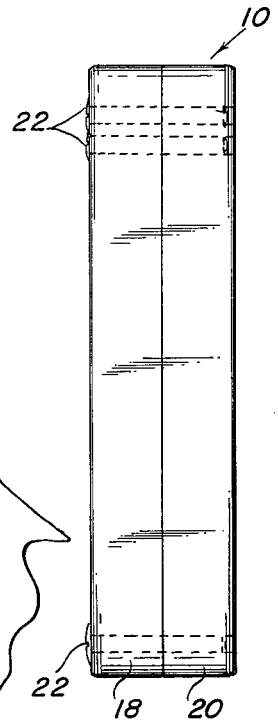
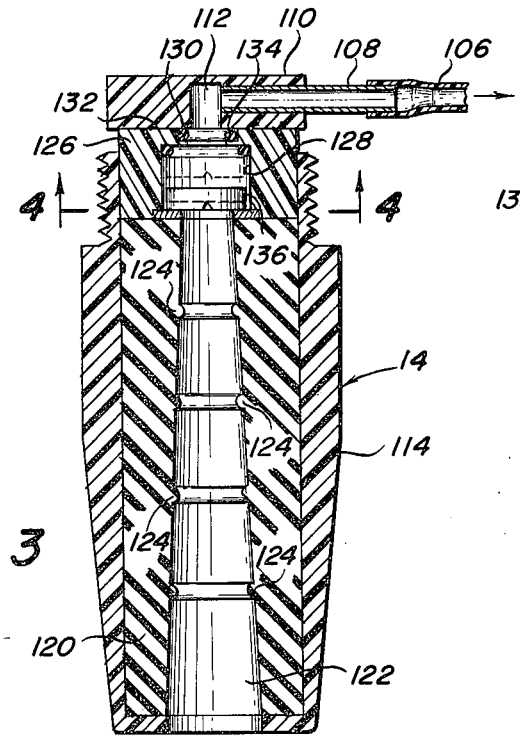
Fig. 3
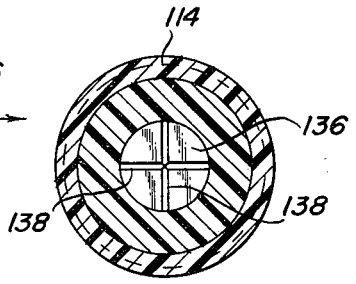
Fig. 4
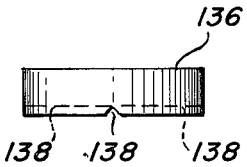
Fig. 5

Fig.6
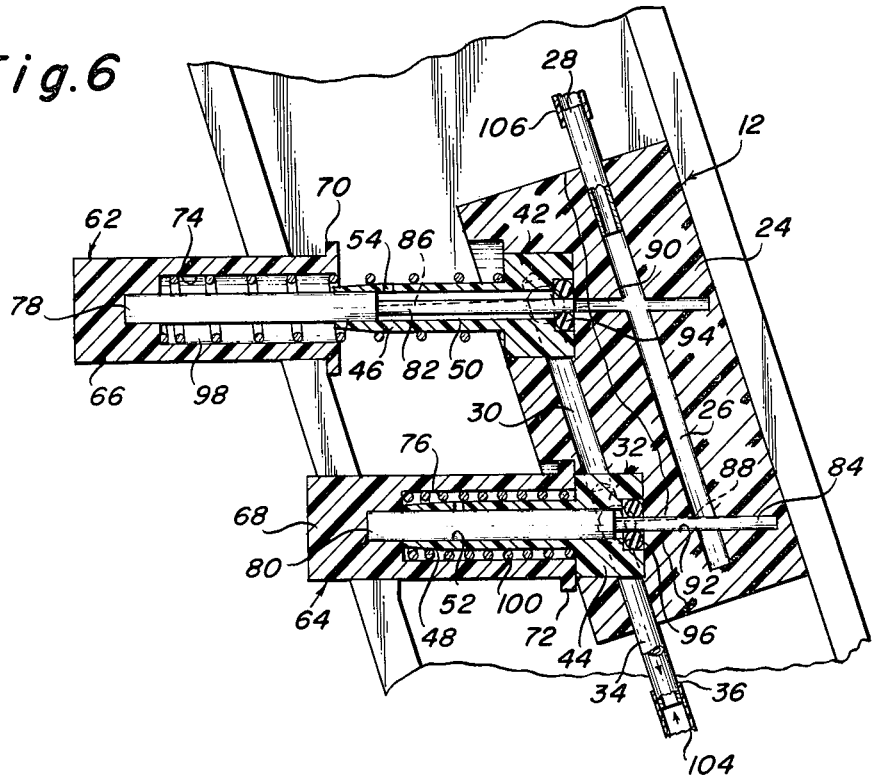
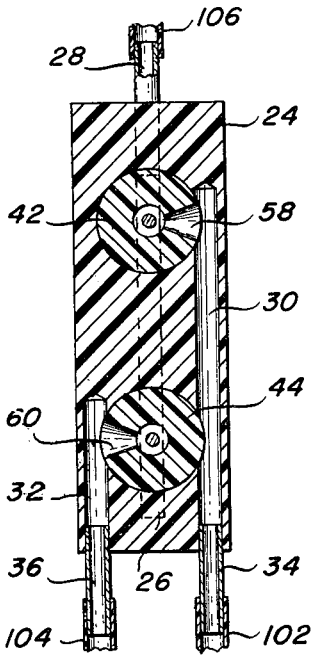
Fig. 7
Fig. 8
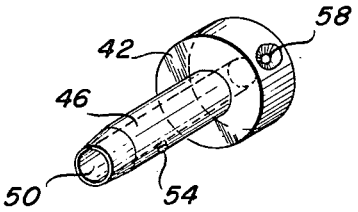
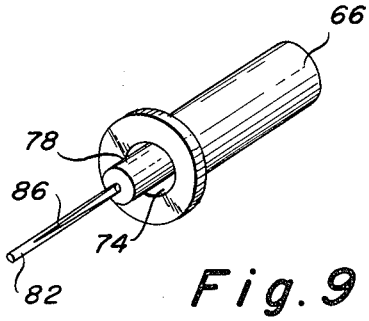
Fig. 9

APPARATUS FOR DRAWING LIQUIDS INTO, AND EXPELLING LIQUIDS FROM A PIPETTE

BACKGROUND AND OBJECTS

The present apparatus is an improvement of the device of my previously granted U.S. Pat. No. 3,834,240 dated Sept. 10, 1974.

As set out in U.S. Pat. No. 3,834,240, the practice of mouth pipetting liquid samples can be harmful and, in many laboratories, such practice has been prohibited. The mechanical devices which have been developed for this purpose such as illustrated by U.S. Pat. Nos. 3,719,087 and 3,656,351 overcome this problem but are cumbersome to operate and can cause a fatigue problem particularly when it is necessary to use these devices for long periods of time. Although the device of U.S. Pat. No. 3,834,240 constitutes an improvement over previously patented devices of this general nature, I have now found that it is possible to provide apparatus having features which constitute improvements over my previously granted patent.

It is an object of this invention to provide apparatus for drawing liquids into, and expelling liquids from, a pipette which is of simple, compact construction, the apparatus being of light weight construction and comfortably held and operated by the user for long periods of time without fatigue.

Another object is to provide apparatus of the character described having a pistol-grip portion to which is connected a pipette-supporting portion which is adapted to hold a variety of sizes of pipettes.

A further object is to provide apparatus of the character described wherein the pistol grip means is provided with a pair of valves underlying the fingers of the user which are connected to pressure and vacuum sources respectively, for selectively controlling the admission of liquid into, and the emission of liquid from a pipette.

A still further object is to provide apparatus of the character described having a pipette holder portion which is provided with valve means for permitting free passage of air to and from the pipette, but which positively prevents liquid from being drawn interiorly of the apparatus.

A further object is to provide apparatus of the character described comprising a minimum of parts which, by virtue of the present arrangement in the apparatus may be readily replaced as needed.

Other objects will be apparent from the following description of the presently preferred form of this invention taken in connection with the appended drawings.

DESCRIPTION OF THE DRAWINGS

FIG. 1 is a side elevational view of the apparatus of the present invention illustrating its use.

FIG. 2 is a rear elevational view of the apparatus of the present invention.

FIG. 3 is an enlarged sectional view of the pipette-supporting portion of the present apparatus, showing to advantage details of construction.

FIG. 4 is a sectional view taken along the line 4—4 of FIG. 3, looking in the direction of the arrow.

FIG. 5 is a side elevational view of a valve forming a part of the pipette supporting portion of the apparatus.

FIG. 6 is an enlarged fragmentary sectional view of the apparatus of the present invention, showing to advantage the valve assembly forming a part of the apparatus.

FIG. 7 is transverse sectional view of the valve block forming a part of the present invention.

FIG. 8 is a perspective view of a valve body forming a part of the present invention.

FIG. 9 is a perspective view of a sliding valve forming a part of the valve assembly.

DETAILED DESCRIPTION OF THE INVENTION

In FIG. 1 there is illustrated the apparatus of the present invention which generally includes a housing 10, a valve assembly 12 and a pipette-supporting portion 14 for holding a pipette 16.

Housing 10 is comprised of a pair of like, complemental sections 18 and 20 which are held together by a plurality of screw members 22. Housing 10 includes a main or grip portion adapted to be held in the hand as shown in FIG. 1, and a barrel portion extending at an angle to the grip portion which is adapted to hold pipette-supporting portion 14.

In accordance with the present invention, a valve assembly 12 is positioned within the grip portion of housing 10 and includes a valve block 24 which is shown to advantage in FIGS. 6 and 7. Valve block 24 includes a longitudinal passageway 26 which extends to a point adjacent but spaced from one terminal of the block. A fitting 28 is mounted in the end of passageway 26 which extends to the periphery of block 24. In spaced relation to longitudinal passageway 26, there are also provided longitudinal passageways 30 and 32, passageway 30 being substantially longer than passageway 32 and being transversely spaced therefrom. Fittings for passageways 30 and 32 are indicated at 34 and 36.

Valve block 24 is provided with a pair of spaced recesses 38 and 40 in which are mounted valve bodies 42 and 44 having elongated tubular portions 46 and 48 through which longitudinal bores 50 and 52 extend. Tubular portions 46 and 48 are further provided with air vents 54 and 56 extending through the side wall of each tubular portion at a point intermediate the length thereof.

Valve bodies 42 and 44 are further provided with conical ducts 58 and 60 which connect longitudinal passageway 30 with bore 50 of valve member 42 and passageway 32 with bore 52 of valve member 44.

In association with valve member 42, there are provided a pair of like sliding valves 62 and 64. Valves 62 and 64 include buttons 66 and 68, the inner ends of which are provided with annular flanges 70 and 72. Adjacent flanges 70 and 72, buttons 66 and 70 have cylindrical recesses 74 and 76 which extend to a point substantially midway of the length of buttons 66 and 68.

Shafts 78 and 80 are fixed at one end to the interior of buttons 66 and 68 and extend axially through longitudinal recesses 74 and 76 to a point beyond peripheral flanges 70 and 72 where the shafts are reduced in cross sectional area as indicated at 82 and 84.

It is a salient feature of the present invention to provide shafts 82 and 84 with tapering air metering grooves 86 and 88. Connecting ducts 90 and 92 establish an air passageway between longitudinal bores 50 and 52 of valve bodies 42 and 44 and longitudinal passageways 30 and 32. O-rings are indicated at 94 and 96.

It will be noted from a consideration of FIG. 6 that longitudinal bores 50 and 52 are of a cross-sectional area to permit entry of shafts 78 and 80 therein and that bores 74 and 76 and buttons 66 and 68 permit entry of elongated tubular portions 46 and 48 therein when the buttons are actuated. Biasing convolute springs are indicated at 98 and 100 for normally urging sliding valves 62 and 64 to inoperative positions.

In accordance with the present invention, air passageway 30 is connected to a source of vacuum by a flexible hose 102, one end of which is engaged with fitting 34. Passageway 32 is connected to a source of pressure by a second flexible hose 104. A third flexible hose 106 is engaged at one end with fitting 28 and extends through the valve portion of the pipette-supporting to pipettesupporting portion 14, as shown to advantage in FIG. 1.

Referring now to FIG. 3, the free end of hose 106 is engaged with a fitting 108 which extends radially outwardly from a circular disc 110. Disc 110 is provided with an axial bore 112 which communicates with hose 106 through fitting 108, the bore in turn being in communication with pipette-supporting portion 14.

Pipette-supporting portion 14 includes a cylindrical outer housing 114, the upper portion of which is reduced and threaded for engagement with a complementally threaded bore 118 of the barrel portion of housing 10.

Pipette-supporting portion 14 is further provided with a cylindrical inner housing 120, the outer periphery of which is engaged with the inner periphery of housing 114. Inner housing 120 is preferably made of rubber or other friction material and is provided with an axial bore 122, the walls of which taper inwardly from the lower to the upper end of the pipette-supporting portion. A series of spaced rings 124 are formed along the inner periphery of the bore to selectively engage and frictionally hold pipettes 16 of various sizes within the pipette-supporting portion.

A disc 126 is positioned within the upper portion of pipette-supporting portion 14 and has a central bore 128 which is reduced in size as indicated at 130 and is in communication with bore 112 of circular disc 110. O-rings are indicated at 132 and 134.

It is a feature of the present invention to provide a disc valve 136 shown to advantage in FIGS. 3, 4 and 5 which is loosely positioned within bore 128 of disc 126 and spaced from the wall of disc 126 defining the bore as shown in FIGS. 3 and 4. The underside of valve disc 136 is provided with an air passageway or passageways 138 in order to permit the passage of air from bore 122 through passageway 138 to that portion of bore 128 between discs 136 and 126, reduced bore 134, axial bore 112, fitting 108 and hose 106 to the valve assembly.

When air is passing in the above matter through the pipette supporting portion, valve disc 136 remains in the position shown in full lines in FIG. 3. However, in the event that liquid is accidentally drawn into pipette-supporting portion 14, disc 136 is lifted by the liquid to the position shown in dotted lines in FIG. 3, the engagement of the upper end of the disc with O-ring 132 acting to seal bore 128 and prevent passage of the liquid upwardly from that point into the housing of the apparatus.

OPERATION

In use of the apparatus of the present invention, pipette 16 is inserted into bore 122 of pipette-supporting portion 14 and frictionally held there by rings 124. The lower end of the pipette is then placed in the liquid to be drawn therein and sliding valve 62 is depressed for the purpose of drawing liquid into the pipette. When the valve is depressed, shaft 82 extends through duct 90 thereby establishing communication between duct 30 and duct 26 by virtue of the communication established therebetween through duct 90, air metering groove 86 and conical duct 58. By virtue of the relatively small diameter of shaft 82, a piston effect is avoided and the liquid may consequently be accurately and quickly drawn into the pipette in the desired amount. button 66 is then released and, under the urging of coil spring 98, the sliding valve returns to its inoperation position.

When it is desired to expel the liquid from the pipette, button 68 is depressed, as shown in FIG. 6, thereby establishing communication between passageway 26 and passageway 32 through duct 92, air metering groove 88 and conical duct 60.

As shown to advantage in FIG. 6, when valves 62 and 64 are in the inoperative postion, the air pressure and vacuum sources are vented to the atmosphere through air vents 54 and 56. However, when valves 62 and 64 are in the operative position, air vents 54 and 56 are blocked off by shafts 78 and 80.

The component parts of the apparatus of the present invention, with the exception of inner housing 120 of pipette-supporting portion 14, are preferably made of a non-corrosive plastic material such as DELRIN, although other materials may be employed, if desired.

By manufacturing the housing in two complemental sections, 18 and 20, the parts thereof are readily accessible for replacement by removal of screws 22 which permit ready access to the valve assembly 12 and parts connected thereto.

The apparatus of the present invention further permits usage with pipettes of various sizes by virtue of the constuction of pipette-supporting portion 14, and valve means are provided for positively preventing passage of liquid interiorly of the apparatus.

The construction of a portion of housing 10 in the shape of a pistol grip permits the apparatus to be easily held in the hand and the location of sliding valves 62 and 64 are such that they are located beneath the index and middle fingers of the user, thereby permitting operation of the apparatus in a normal way without fatigue when operated for an extended period of time.

While there has been herein shown and described the presently preferred form of this invention, it is to be understood that such has been done for purposes of illustration only, and that various changes may be made therein within the scope of the appended claims.

What is claimed is:

1. Apparatus for drawing liquid into, and expelling liquid from a pipette, including:

a. a housing comprising a hand grip portion and a barrel portion, b. a pipette-supporting portion connected to said barrel portion, c. an air pressure source, d. a vacuum source, e. duct means connecting said air pressure source and vacuum source to said pipette-supporting portion, f. a first valve means carried by said hand grip portion in operative engagement with said duct means and operable to selectively establish, and cut off, communication between said pipette-supporting portion, air pressure source and vacuum source, and g. a second valve means in said pipette-supporting portion for preventing passage of liquid from the pipette through said pipette-supporting portion to said housing but permitting free passage of air therethrough.

2. The apparatus of claim 1, wherein:

a. said pipette-supporting portion includes an air passageway establishing communication between the pipette and said duct means, and b. said second valve means includes a movable member positioned in said air passageway, c. means for normally permitting air to flow past said movable member between the pipette and housing, d. sealing means in said air passageway normally in spaced relation to said movable member, e. said movable member being relocated under liquid pressure into engagement with said sealing means to prevent passage of liquid into said housing.

3. The apparatus of claim 2, wherein:

a. said movable member comprises a disc, and b. said sealing member is an O-ring which, when engaged with said disc, effectively seals the air passageway between the pipette and said housing.

4. The apparatus of claim 3, wherein:

a. an air space is provided between said disc and that part of said pipette-supporting portion defining said air passageway, and b. means on said disc for permitting passage of air from beneath said disc to the air space between said disc and that part of said pipette-supporting portion defining the air passageway.

5. The apparatus of claim 4, wherein:

a. said means on said disc includes air grooves formed in one face of said disc for conducting air to the air space.

6. The apparatus of claim 1, wherein:

a. said pipette-supporting portion includes an elongated housing, b. said housing having a bore extending longitudinally therethrough and being tapered from one end to the other for accommodating pipettes of various sizes, and c. means on said housing proximate said bore for frictionally engaging the pipette to retain the latter within said pipette-supporting portion.

7. The apparatus of claim 6, wherein:

a. said means for frictionally engaging the pipette includes a housing made of friction material.

8. The apparatus of claim 7, wherein:

a. said friction housing includes a plurality of spaced rings of friction material for grippingly engaging the pipette.

9. Apparatus for drawing liquid into, and expelling liquid from, a pipette including:

a. a housing comprising a hand grip portion and a barrel portion, b. a pipette-supporting portion connected to said barrel portion, c. an air pressure source, d. a vacuum source, e. a valve assembly f. said valve assembly including a valve block within the hand grip portion of said housing, g. a plurality of duct members in said valve block, h. a first conduit means connecting one of said duct members to said air pressure source, i. a second conduit means connecting a second duct member to said vacuum source, j. a third conduit means connecting a third duct member to said pipette-supporting portion, and k. a pair of valve members positioned in said valve block operable to selectively establish communication between said first and second duct members and said third duct member for applying air pressure and vacuum to the pipette.

10. The apparatus of claim 9, wherein:

a. said pair of valve members includes a pair of valve bodies mounted in said valve block, b. a pair of sliding valves in engagement with said body members, c. said sliding valves, when actuated, establishing communication respectively between said air pressure source and said pipette-supporting portion and said vacuum source and said pipette-supporting portion.

11. The apparatus of claim 10, wherein:

a. each of said sliding valves includes a shaft, b. said shaft being provided with a longitudinal tapering air groove for controlling the passage of air between the air pressure source, vacuum source and pipette-supporting portion, whereby liquid may be drawn into, and expelled from, the pipette at the desired rate.

12. The apparatus of claim 9, with the addition of:

a. a second valve means in said pipette-supporting portion for preventing passage of liquid from the pipette through said pipette-supporting portion to said housing but permitting free passage of air therethrough.

13. The apparatus of claim 12, wherein:

a. said pipette-supporting portion includes an air passageway establishing communication between the pipette and said duct means, and b. said second valve means includes a movable member positioned in said air passageway, c. means for normally permitting air to flow past said movable member between the pipette and housing, d. sealing means in said air passageway normally in spaced relation to said movable member, e. said movalbe member being relocated under liquid pressure into engagement with said sealing means to prevent passage of liquid into said housing.

14. The apparatus of claim 13, wherein:

a. said movable member comprises a disc, and b. said sealing member is an O-ring which, when engaged with said disc, effectively seals the air passageway between the pipette and said housing.

15. The apparatus of claim 14, wherein:

a. an air space is provided between said disc that part of said pipette-supporting portion defining said air passageway, and b. means on said disc for permitting passage of air from beneath said disc to the air space between said disc and that part of said pipette-supporting portion defining the air passageway.

16. The apparatus of claim 15, wherein:

a. said means on said disc includes air grooves formed in one face of said disc for conducting air to the air space.

* * * * *